US010145041B2

(12) United States Patent
Terai et al.

(10) Patent No.: US 10,145,041 B2
(45) Date of Patent: Dec. 4, 2018

(54) METHOD FOR KNITTING SHOE UPPER AND SHOE UPPER

(71) Applicant: SHIMA SEIKI MANUFACTURING, LTD., Wakayama-shi, Wakayama (JP)

(72) Inventors: Kenta Terai, Wakayama (JP); Yoshinori Shimasaki, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 15/534,259

(22) PCT Filed: Nov. 25, 2015

(86) PCT No.: PCT/JP2015/083123

§ 371 (c)(1),
(2) Date: Jun. 8, 2017

(87) PCT Pub. No.: WO2016/104029

PCT Pub. Date: Jun. 30, 2016

(65) Prior Publication Data

US 2018/0077999 A1 Mar. 22, 2018

(30) Foreign Application Priority Data

Dec. 22, 2014 (JP) ..... 2014-259307

(51) Int. Cl.
*D04B 1/24* (2006.01)
*A43B 23/02* (2006.01)
(Continued)

(52) U.S. Cl.
CPC ..... *D04B 1/24* (2013.01); *A43B 23/02* (2013.01); *D04B 1/106* (2013.01); *D04B 1/22* (2013.01);
(Continued)

(58) Field of Classification Search
CPC .. D04B 1/22; D04B 1/24; D04B 1/106; A43B 23/02; A43B 23/025; A43B 1/04
See application file for complete search history.

(56) References Cited

U.S. PATENT DOCUMENTS

| | | | |
|---|---|---|---|
| 5,428,975 | A | 7/1995 | Lee, III et al. |
| 2016/0000173 | A1 | 1/2016 | Spielmann et al. |
| 2016/0053415 | A1 | 2/2016 | Ikenaka et al. |

FOREIGN PATENT DOCUMENTS

| | | | |
|---|---|---|---|
| JP | 2014508009 | A | 4/2014 |
| WO | WO 2012125473 | A2 | 9/2012 |

(Continued)

OTHER PUBLICATIONS

International Search Report with English translation and Written Opinion (Japanese only) issued in International Patent Application No. PCT/JP2015/083123, 8 pages (dated Jun. 30, 2016).

*Primary Examiner* — Danny Worrell
(74) *Attorney, Agent, or Firm* — Rothwell, Figg, Ernst & Manbeck, P.C.

(57) ABSTRACT

A method for knitting a shoe upper capable of forming a new stretch preventing section different from a conventional stretch preventing section, and a shoe upper obtained through such knitting method are provided. The shoe upper including a base knitted fabric portion (1F) that covers a foot of a wearer is knitted. In the knitting, a stretch preventing section (20) configured by a knitted fabric of a plain structure is knitted, where one end in a wale direction is connected to the base knitted fabric portion (1F) and another end in the wale direction is not connected to the base knitted fabric portion (1F). The stretch preventing section (20) in which one end is fixed and the other end is not fixed is curled to a tubular shape. The curled stretch preventing section (20) is thicker than the other portions, thus suppressing the stretch of the shoe upper.

6 Claims, 6 Drawing Sheets

(51) Int. Cl.

| | |
|---|---|
| ***D04B 1/22*** | (2006.01) |
| ***D04B 1/10*** | (2006.01) |
| *A43B 1/04* | (2006.01) |

(52) U.S. Cl.
CPC ..... *A43B 1/04* (2013.01); *D10B 2403/0113* (2013.01); *D10B 2501/043* (2013.01)

(56) References Cited

FOREIGN PATENT DOCUMENTS

| | | | |
|---|---|---|---|
| WO | WO 2014131762 | A2 | 9/2014 |
| WO | WO 2014163008 | A1 | 10/2014 |

METHOD FOR KNITTING SHOE UPPER AND SHOE UPPER

CROSS-REFERENCE TO RELATED APPLICATION

This application is a 35 U.S.C. 371 National Phase Entry Application from PCT/JP2015/083123, filed Nov. 25, 2015, which claims the benefit under 35 U.S.C. § 119(a) of the filing date of Japanese patent application No. 2014-259307, filed Dec. 22, 2014, the respective disclosure(s) which is(are) incorporated herein by reference.

TECHNICAL FIELD

The present invention relates to a method for knitting a shoe upper for forming a stretch preventing section, and a shoe upper including the stretch preventing section.

BACKGROUND ART

A shoe includes a shoe upper configured by a sole cover that covers a sole of a wearer, and an instep cover that covers a portion on an instep side of the wearer. With outdoor shoes, an outer sole made of synthetic resin and the like is attached to the sole cover of the shoe upper. In recent years, of the instep cover and the sole cover configuring the shoe upper, the instep cover is configured with one knitted fabric in an attempt to produce the shoe with high productivity. For example, in Patent Document 1, the instep cover in a planar developed state is produced with one knitted fabric, which is then joined to the outer sole made of synthetic resin and the like along with the sole cover to complete the shoe.

The shoe upper described above is knitted with a knitting yarn including a thermally fused yarn and a non-thermally fused yarn, and is shaped by performing thermal process after the knitting. As a result, the stitches configuring the shoe upper, that is, the shoe upper is less likely to lose shape. A few areas that particularly require strength exist in such shoe upper. For example, in Patent Document 1, a stretch preventing section in which an inlay knitting yarn is interweaved in a portion from a vicinity of an eyelet, through which a shoelace is passed, to a side surface of the instep cover is formed to reinforce the relevant portion.

PRIOR ART DOCUMENT

Patent Document

[Patent Document 1] International Publication WO 2012-125473

DISCLOSURE OF THE INVENTION

Problems to be Solved by the Invention

When the stretch preventing section is formed in the shoe upper using the inlay knitting yarn, a part of the inlay knitting yarn appears on the surface of the shoe upper. The inlay knitting yarn appearing on the surface can be used as a decoration of the shoe upper. In recent years, however, the needs of customers are becoming diversified, and some customers may not like the decoration by the inlay knitting yarn. Thus, a method for knitting the shoe upper capable of forming a new stretch preventing section different from the conventional stretch preventing section, and a shoe upper obtained through such knitting method are desired.

The present invention was made in view of the above-described circumstances, and it is an object thereof to provide a method for knitting a shoe upper capable of forming a new stretch preventing section different from the conventional stretch preventing section. Another object of the present invention is to provide a shoe upper including the new stretch preventing section different from the conventional stretch preventing section.

Means for Solving the Problems

An aspect of the present invention relates to a method for knitting a shoe upper of knitting the shoe upper including a base knitted fabric portion that covers a foot of a wearer using a flat knitting machine including a front needle bed and a back needle bed disposed opposite to each other in a front-back direction. In the method for knitting the shoe upper, knitting I or knitting II is carried out to knit a stretch preventing section configured by a knitted fabric of a plain structure, one end in a wale direction being connected to the base knitted fabric portion by knitting, and another end in the wale direction being curled without being connected to the base knitted fabric portion.

[Knitting I] Process $\alpha_1$ of knitting, with a stitch of a forming region where the stretch preventing section is formed in the base knitted fabric portion held on one needle bed, a set up portion of the stretch preventing section on another needle bed, process $\alpha_2$ of knitting a plurality of new stitch rows continuing in a wale direction of the set up portion, and process $\alpha_3$ of connecting the last new stitch row to the stitch of the base knitted fabric portion of the forming region are carried out.

[Knitting II] Process $\beta_1$ of knitting, with a stitch of the forming region where the stretch preventing section is formed in the base knitted fabric portion held on only one needle bed, a branched stitch row branched from the base knitted fabric portion on another needle bed, process $\beta_2$ of knitting a plurality of new stitch rows continuing in a wale direction of the branched stitch row, and process $\beta_3$ of performing a bind-off process on the last new stitch row are carried out.

According to one aspect of the method for knitting the shoe upper of the present invention, [procedure 1] of knitting the shoe upper from a foot insertion opening side toward a sole side, and knitting the stretch preventing section according to the knitting I; or [procedure 2] of knitting the shoe upper from the sole side toward the foot insertion opening side, and knitting the stretch preventing section according to the knitting II, is carried out.

According to one aspect of the method for knitting the shoe upper of the present invention, process $\gamma_1$ to process $\gamma_3$ are carried out to knit a holding stitch to be wound around an outer peripheral surface of a curled shape of the stretch preventing section to hold the curled shape of the stretch preventing section.

[Process $\gamma_1$] Knitting the holding stitch continuing in a wale direction of at least some stitches of the base knitted fabric portion of the forming region before knitting the stretch preventing section.

[Process $\gamma_2$] Forming, with only the holding stitch held on the other needle bed, the stretch preventing section with the other needle bed according to the procedure of knitting I or knitting II.

[Process $\gamma_3$] Connecting the holding stitch to the base knitted fabric portion.

An aspect of the present invention relates to a shoe upper including a base knitted fabric portion that covers a foot of a wearer. The shoe upper includes a stretch preventing section integrally formed with the base knitted fabric portion. The stretch preventing section is configured with a knitted fabric of a plain structure, one end in a wale direction being connected to the base knitted fabric portion by knitting and another end in the wale direction being curled without being connected to the base knitted fabric portion.

According to one aspect of the shoe upper of the present invention, the shoe upper includes a holding stitch knitted in continuation to a wale direction of a stitch of the base knitted fabric portion, and connected to the base knitted fabric portion while being wound around an outer peripheral surface of a curled shape of the curled stretch preventing section; where the curled shape of the stretch preventing section is maintained by the holding stitch.

Effects of the Invention

According to the method for knitting the shoe upper of the present invention, the shoe upper of the present invention including the curled stretch preventing section configured by the knitted fabric of a plain structure can be knitted. The knitted fabric of the plain structure has a property in which the end in the wale direction curls, and thus the side that is not fixed to the base knitted fabric portion in the stretch preventing section configured by the plain structure naturally curls. As the stretch preventing section formed when the knitted fabric of the plain structure is curled is thicker than the other portions, thus effectively suppressing the stretch of the shoe upper. Furthermore, the thick stretch preventing section reinforces the shoe upper and serves as a frame for three-dimensionally holding the overall shape of the shoe upper. In addition, the thick stretch preventing section protrudes from other portions of the shoe upper thus serving as a decoration of the shoe upper.

According to the method for knitting the shoe upper of the present invention in which [procedure 1] or [procedure 2] is carried out, the stretch preventing section can be knitted such that the direction in which the stretch preventing section curls becomes the downward side of the shoe upper. According to the stretch preventing section that curls toward the downward side of the shoe upper, the curled shape is less likely to be deformed, and dust is less likely to accumulate inside the curled stretch preventing section. As described in the embodiments below, when forming the stretch preventing section at the foot insertion opening of the shoe upper, the curled stretch preventing section can be prevented from entering inside the foot insertion opening, and the stretch preventing section does not get in the way of wearing the shoe upper as long as the direction in which the stretch preventing section curls is directed toward the downward side.

According to the method for knitting the shoe upper of knitting the holding stitch of holding down the stretch preventing section from the outer periphery, the shoe upper in which the curled shape of the stretch preventing section is held by the holding stitch can be knitted.

MODE FOR CARRYING OUT THE INVENTION

Hereinafter, embodiments of a shoe upper and a method for knitting the same according to the present invention will be described based on the drawings. In the embodiments, a knitting example using a two-bed flat knitting machine including a front needle bed (hereinafter referred to as FB) and a back needle bed (hereinafter referred to as BB) extending in a traverse direction and disposed opposite to each other in a front-back direction, and a yarn feeder that feeds a knitting yarn, where the BB is rackable to the right and left and stitches can be transferred will be described. The flat knitting machine used, of course, is not limited to the two-bed flat knitting machine, and for example, may be a four-bed flat knitting machine.

First Embodiment

<<Overall Configuration>>

Figure 1:
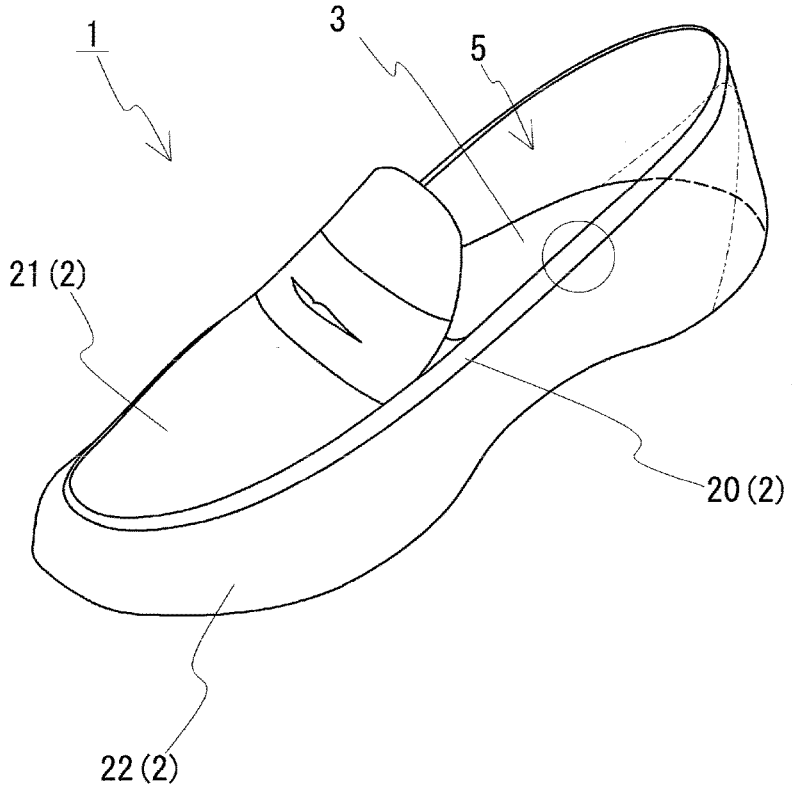
FIG. 1 is a schematic perspective view of a shoe upper of a first embodiment.

A shoe upper 1 shown in FIG. 1 is configured by an instep cover 2 that covers a portion on an instep side of a foot and a sole cover 3 that covers a sole, and is knitted by the flat knitting machine in a seamless manner. The instep cover 2 and the sole cover 3 are both base knitted fabric portions that cover the foot of the wearer. The sole cover 3 may be prepared separately from the instep cover 2 and integrated with the instep cover 2.

The instep cover 2 (base knitted fabric portion) is formed with an annular stretch preventing section 20 including a rim of a foot insertion opening 5. The stretch preventing section 20 has a function of suppressing the stretch of the shoe upper 1 and a function serving as a frame for holding a three-dimensional shape of the shoe upper 1, and decorates the shoe upper 1. In the following description, a portion on the upper side of the stretch preventing section 20 in the instep cover 2 is referred to as an instep part 21 and a portion on the lower side thereof is referred to as a side part 22.

<<Stretch Preventing Section>>

Figure 2:
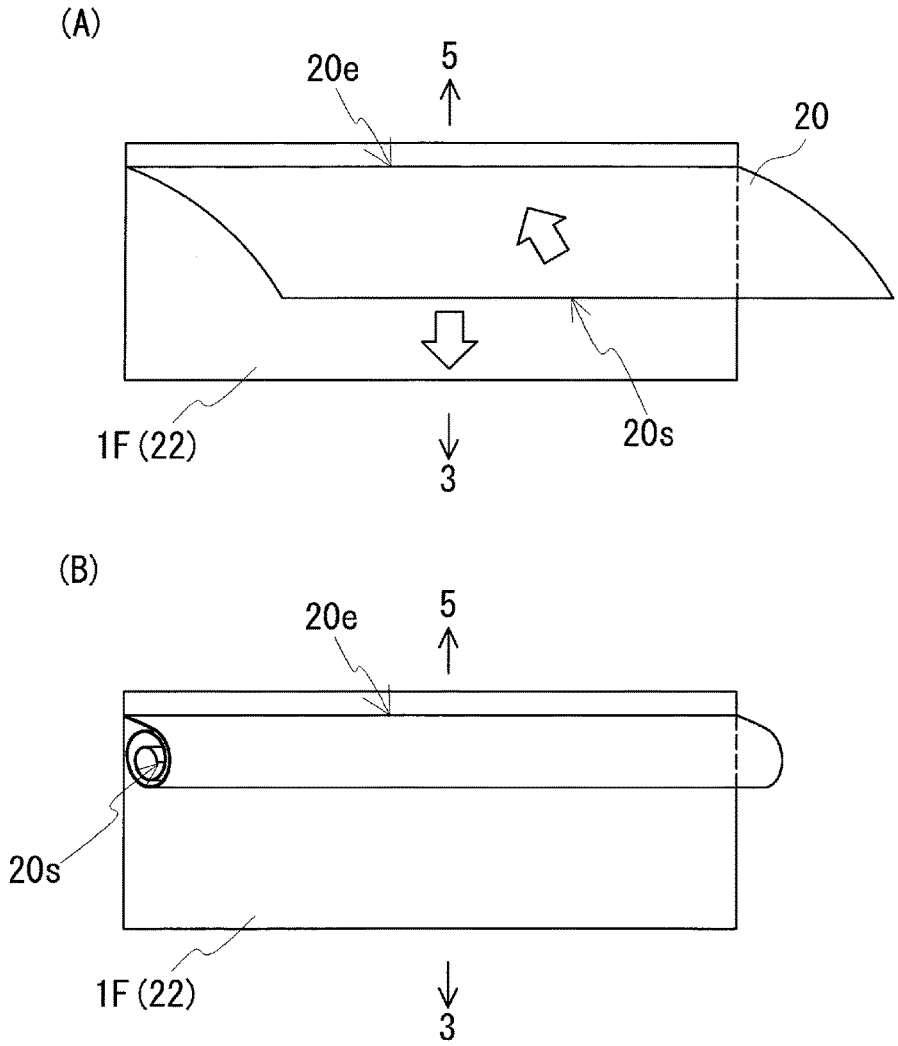
FIG. 2(A) is a schematic view of a stretch preventing section arranged in the shoe upper of the first embodiment.
FIG. 2(B) is a schematic view showing a state in which the stretch preventing section of FIG. 2(A) is curled.

The configuration of the stretch preventing section 20 will be described based on FIG. 2 using a circled portion in the stretch preventing section 20 shown in FIG. 1 by way of example. In FIG. 2, an upper side in the plane of drawing is the foot insertion opening 5 side and a lower side in the plane of drawing is the sole cover 3 side.

As shown in FIG. 2(A), the stretch preventing section 20 is a planar knitted fabric connected to a base knitted fabric portion 1F (left side portion of side part 22 of FIG. 1). The base knitted fabric portion 1F and the stretch preventing section 20 are knitted according to a knitting method, to be described below, where a knitting direction (direction of stitches) of the base knitted fabric portion 1F is directed downward in the plane of drawing, and a knitting direction (direction of stitches) of the stretch preventing section 20 is directed upward in the plane of drawing (knitting direction of each section is indicated with outlined arrow). The stretch preventing section 20 has a starting end 20*s* in a wale direction thereof not connected to the base knitted fabric portion 1F and a terminating end 20*e* in the wale direction connected to the base knitted fabric portion 1F by knitting.

The stretch preventing section 20 of the present example is a knitted fabric of plain structure, and is configured by stitches that become back stitches when seen from the near side in the plane of drawing of FIG. 2(A). The knitted fabric of plain structure has a property of curling in a direction the stitches are drawn, that is, the knitted fabric curls such that a surface on which the back stitches are seen becomes the outer side. Thus, the stretch preventing section 20 configured with the back stitches drawn from the near side toward the far side in the plane of drawing curls toward the lower side in the plane of drawing, as shown in FIG. 2(B). The stretch preventing section 20 has a curled tubular shape as a whole, where when a transverse section of the stretch preventing section 20 is seen, the knitted fabric configuring the stretch preventing section 20 is curled up to a spiral shape.

A forming position of the stretch preventing section 20 is not limited to the position shown in FIG. 1. For example, the stretch preventing section 20 may be formed at a boundary portion of the instep cover 2 and the sole cover 3. In addition, the stretch preventing section 20 extending in a diagonal direction to an arch form may be formed at a heel portion of the instep cover 2 indicated with a chain double dashed line of FIG. 1. The stretch preventing section 20 in which one end of the arch is arranged on a right side surface of the instep cover 2, the other end of the arch is arranged on a left side surface of the instep cover 2, and an intermediate part of the arch is arranged at a position closer to the foot insertion opening 5 of the heel suppresses the heel from losing shape.

<<Method for Knitting Shoe Upper>>

Figure 3:
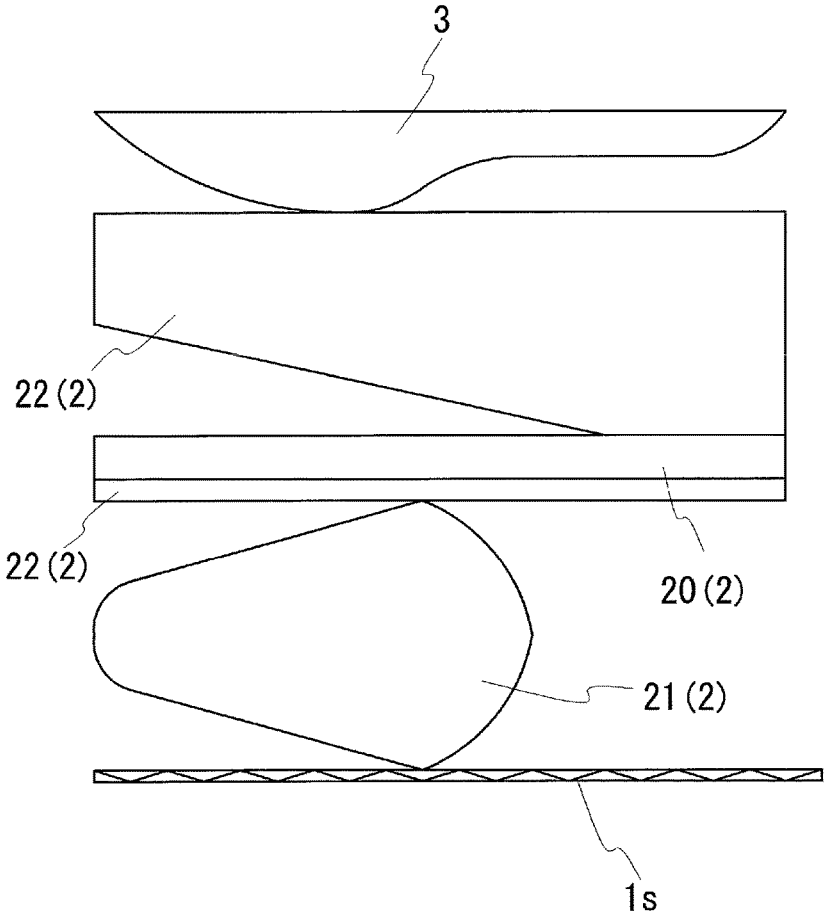
FIG. 3 is a knitting image view schematically showing a knitting procedure of the shoe upper of the first embodiment.

Before describing a knitting procedure of the stretch preventing section 20, an overall knitting procedure of the shoe upper 1 will be described first. The shoe upper 1 can be knitted through, for example, the procedure shown in FIG. 3. In the procedure shown in FIG. 3, the shoe upper 1 is knitted sideways on the needle beds. In FIG. 3, only the right side portion is illustrated for the portion where the stretch preventing section 20 is formed, the side part 22, and the sole cover 3, where the left side portion thereof is on the far side of the right side portion.

In FIG. 3, first, a set up portion 1*s* is formed on the FB and the BB. Following the set up portion 1*s*, the instep part 21 of the instep cover 2 is knitted using the FB (or BB). Then, one part of the side part 22 of the instep cover 2 is knitted using the FB and the BB, and then the stretch preventing section 20 is knitted and joined to the side part 22. Furthermore, the side part 22 of the instep cover 2 is knitted through tubular knitting and reciprocate knitting using the FB and the BB. The reciprocate knitting is separately carried out on the FB and the BB to knit the right side portion and the left side portion of the sole cover 3, and such right side portion and left side portion are connected by knitting at the end.

<<Configuration of Stretch Preventing Section>>

Figure 4:
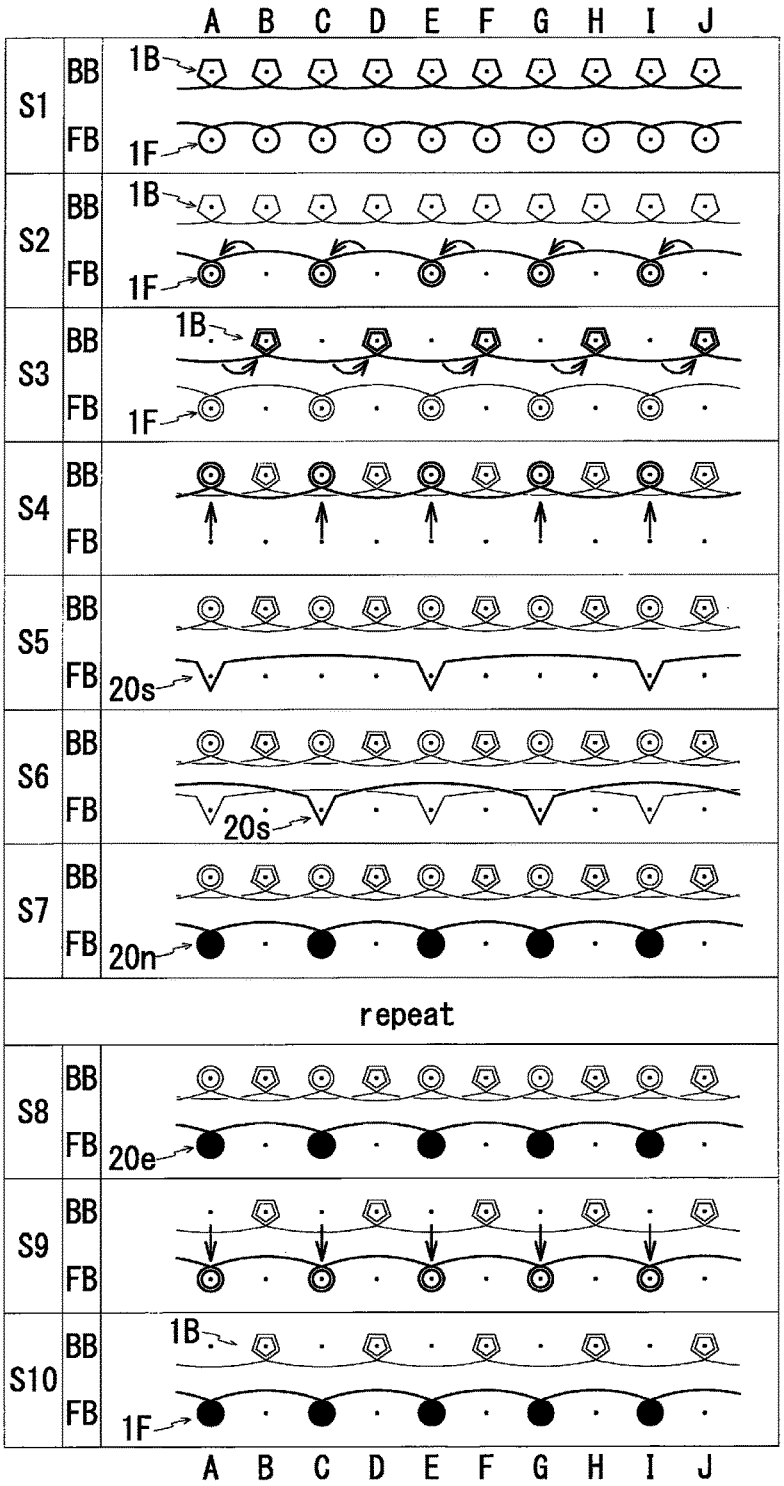
FIG. 4 is a knitting process diagram of the stretch preventing section arranged in the shoe upper of the first embodiment.

The stretch preventing section 20 shown in FIG. 3 can be knitted according to the knitting process diagram shown in FIG. 4. "Alphabet+number" in the left column of FIG. 4 indicates the number of knitting process, and the formed state of the stitches in the FB and the BB is shown in the right column. A portion where the knitting is actually carried out in each process is shown with a thick line. An upper case alphabet in the figure indicates the position of a knitting needle, and a double mark indicates a double stitch.

In S1, a state in which one part of the side part 22 is knitted with the FB and the BB after the knitting of the instep part 21 of FIG. 3 is finished is shown. The base knitted fabric portion 1F (circled mark) held on the knitting needles A to J of the FB corresponds to a right side portion of the side part 22, and a base knitted fabric portion 1B (pentagon mark) held on the knitting needles A to J of the BB corresponds to a left side portion of the side part 22. Wool yarn, elastic yarn, thermally fused yarn or the like can be used for a knitting yarn configuring the base knitted fabric portions 1F, 1B. In particular, the base knitted fabric portions 1F, 1B are preferably configured with the thermally fused yarn.

An empty needle is not provided within a knitting width of the base knitted fabric portions 1F, 1B, so that the base knitted fabric portions 1F, 1B formed with tight stitches are obtained. The stretch preventing section 20 is formed from this state over an entire width of the base knitted fabric portion 1F. In this case, all of the knitting needles A to J become a forming region of the stretch preventing section 20. A knitting yarn configuring the stretch preventing section 20 is not particularly limited, but is preferably a thermally fused yarn. With the stretch preventing section 20 formed using the thermally fused yarn, the strength of the stretch preventing section 20 can be enhanced by thermal process, and as a result, the function of the stretch preventing section 20 can be enhanced.

In S2, a part of the base knitted fabric portion 1F is moved toward the left side in the knitting width direction, and an empty needle is provided within the knitting width of the base knitted fabric portion 1F. In S3, some stitches of the base knitted fabric portion 1B are moved toward a right side in the knitting width direction, and an empty needle is provided within the knitting width of the base knitted fabric portion 1B. A holding mechanism capable of temporarily moving the stitches to the knitting needles is used for the movement of the stitches of S1 and S2. The empty needles are provided to prepare for the knitting of the stretch preventing section 20. In the present example, the stitches held on the knitting needles B, D, F, H, J of the FB are overlapped with the stitches on their left in the plane of drawing in S2, and the stitches held on the knitting needles A, C, E, G, I of the BB are overlapped with the stitches on their right in the plane of drawing in S3, so that the knitting needles B, D, F, H, J of the FB and the knitting needles A, C, E, G, I of the BB become empty needles.

In S4, stitches of the base knitted fabric portion 1F held on the knitting needles A, C, E, G, I of the FB are transferred to the knitting needles A, C, E, G, I of the BB (part of process $\alpha_1$). According to such knitting, a state in which not even one stitch of the base knitted fabric portions 1F, 1B is held on the knitting needles A to J of the FB, which are the forming region of the stretch preventing section 20, is obtained. Thus, even if the stretch preventing section 20 is knitted through the following process, the stretch preventing section 20 will not be interweaved in the base knitted fabric portions 1F, 1B.

In S5 and S6, a set up portion of the stretch preventing section 20, that is, a starting end 20*s* of the stretch preventing section 20 shown in FIG. 2 is knitted on the FB (part of process $\alpha_1$). Specifically, the set up portion 20*s* of the stretch preventing section 20 is knitted by carrying out an interlock knitting of forming a pickup stitch on the knitting needles A, E, I of the FB in S5, and of forming a pickup stitch on the knitting needles C, G of the FB in S6.

The knitting yarn for knitting the stretch preventing section 20 may be the knitting yarn same as the knitting yarn of the base knitted fabric portion 1F, or may be a knitting yarn of different material, texture, thickness, or color. In the latter case, the stretch preventing section 20 can stand out. If the knitting yarn of the stretch preventing section 20 and the knitting yarn of the base knitted fabric portion 1F are the same, a yarn feeder used for the knitting of the base knitted fabric portion 1F can be used for the knitting of the stretch preventing section 20.

In S7, a new stitch row 20*n* continuing in a wale direction of the set up portion 20*s* is knitted. Further knitting of the new stitch row 20*n* in the wale direction of the new stitch row 20*n* is repeated for a predetermined number of times (process $\alpha_2$). The repeating number of times can be appropriately selected depending on the desired length from the starting end 20*s* to the terminating end 20*e* of the stretch preventing section 20 (see top view of FIG. 2).

In S8, a state in which the last new stitch row, that is, the terminating end 20*e* of the stretch preventing section 20 shown in FIG. 2(A) is held on the knitting needles A, C, E, G, I of the FB is shown. From this state, the last new stitch row 20*e* held on the knitting needles A, C, E, G, I of the FB and the stitches of the base knitted fabric portion 1F temporarily moved to the knitting needles A, C, E, G, I of the BB in S4 are overlapped in S9, (one part of process $\alpha_3$).

In S10, the stitches of the base knitted fabric portion 1F following the wale direction of the double stitches formed in S9 are formed, and the last new stitch row 20*e* is connected to the stitches of the base knitted fabric portion 1F (part of process $\alpha_3$).

The stretch preventing section 20 in which the terminating end 20*e* is connected to the base knitted fabric portion 1F shown in FIG. 2(A) can be knitted by knitting the shoe upper 1 from the foot insertion opening 5 side toward the sole side, and knitting the stretch preventing section 20 according to the knitting processes of FIG. 4 in the process of such knitting. The stretch preventing section 20 naturally curls toward the sole cover 2, as shown in FIG. 2(B), due to the properties of the plain structure.

The stretch preventing section 20 can also be formed with respect to the base knitted fabric portion 1B of FIG. 4. In this case, the stretch preventing section 20 can be formed in the base knitted fabric portion 1B through a procedure similar to the procedure shown in S4 to S10. In addition, in S10, the stitch may be formed at the position of the empty needle, and the number of stitches in the knitting width direction may be returned to the same number as the number shown in S1.

Second Embodiment

In the first embodiment, an example of knitting the stretch preventing section 20 independent from the base knitted fabric portion 1F, and connecting the terminating end 20*e* of the stretch preventing section 20 to the base knitted fabric portion 1F has been described, as shown in the knitting process diagram of FIG. 4. On the contrary, the base knitted fabric portion 1F may be branched, and then the stretch preventing section 20 may be knitted.

A procedure for branching the stretch preventing section 20 will be briefly described using the knitting process diagram of FIG. 4. First, after carrying out the processes up to S3 of FIG. 4, split knitting is carried out on the base knitted fabric portion 1F held on the knitting needles A, C, E, G, I of the FB. The stitches of the base knitted fabric portion 1F held on the knitting needles A, C, E, G, I of the FB are transferred to the knitting needles A, C, E, G, I of the BB, and a branched stitch row is knitted on the knitting needles A, C, E, G, I of the FB by carrying out the split knitting (corresponding to process $\beta_1$).

The branched stitch row is not limited to being formed by split knitting. For example, after the stitches of the base knitted fabric portion 1F held on the knitting needles A, C, E, G, I of the FB are transferred to the knitting needles A, C, E, G, I of the BB, tuck can be carried out on the base knitted fabric portion 1F and the pickup stitch can be formed on the knitting needles A, C, E, G, I of the FB to knit the branched stitch row including the pickup stitch.

After the branched stitch row is knitted, a plurality of new stitch rows continuing in the wale direction of the branched stitch row is knitted (process $\beta_2$). After a predetermined number of new stitch rows is knitted, the last new stitch row is performed with a bind-off process (process $\beta_3$).

The stretch preventing section 20 for suppressing the stretch of the base knitted fabric portion 1F can also be knitted according to the procedure described above.

When knitting the stretch preventing section 20 by branching, the shoe upper 1 is preferably knitted from the sole side toward the foot insertion opening 5 side. The stretch preventing section 20 that naturally curls toward the sole cover section 3 side (downward side) thus can be knitted.

Third Embodiment

In a third embodiment, a shoe upper formed with a holding stitch 40 for holding a curled shape of the stretch preventing section 20 will be described based on FIGS. 5 and 6. An outlined arrow of FIG. 5(A) indicates a knitting direction of the base knitted fabric portion 1F.

As shown in FIGS. 5(A) and 5(B), the holding stitch 40 is wound around an outer peripheral surface of the curled shape of the stretch preventing section 20. A lower end (upper side in the plane of drawing) in the wale direction of the holding stitch 40 indicated with a black arrow head and an upper end (lower side in the plane of drawing) in the wale direction of the holding stitch 40 indicated with a white arrow head are connected to the base knitted fabric portion 1F by knitting. That is, the wale direction of the holding stitch 40 wound around the outer periphery of the stretch preventing section 20 having the curled shape lies along the circumferential direction of the stretch preventing section 20. The holding stitch 40 holds down the stretch preventing section 20 from the circumferential direction of the stretch preventing section 20 and holds the curled shape of the stretch preventing section 20 so that the curled shape of the stretch preventing section 20 is not deformed.

Figure 5:
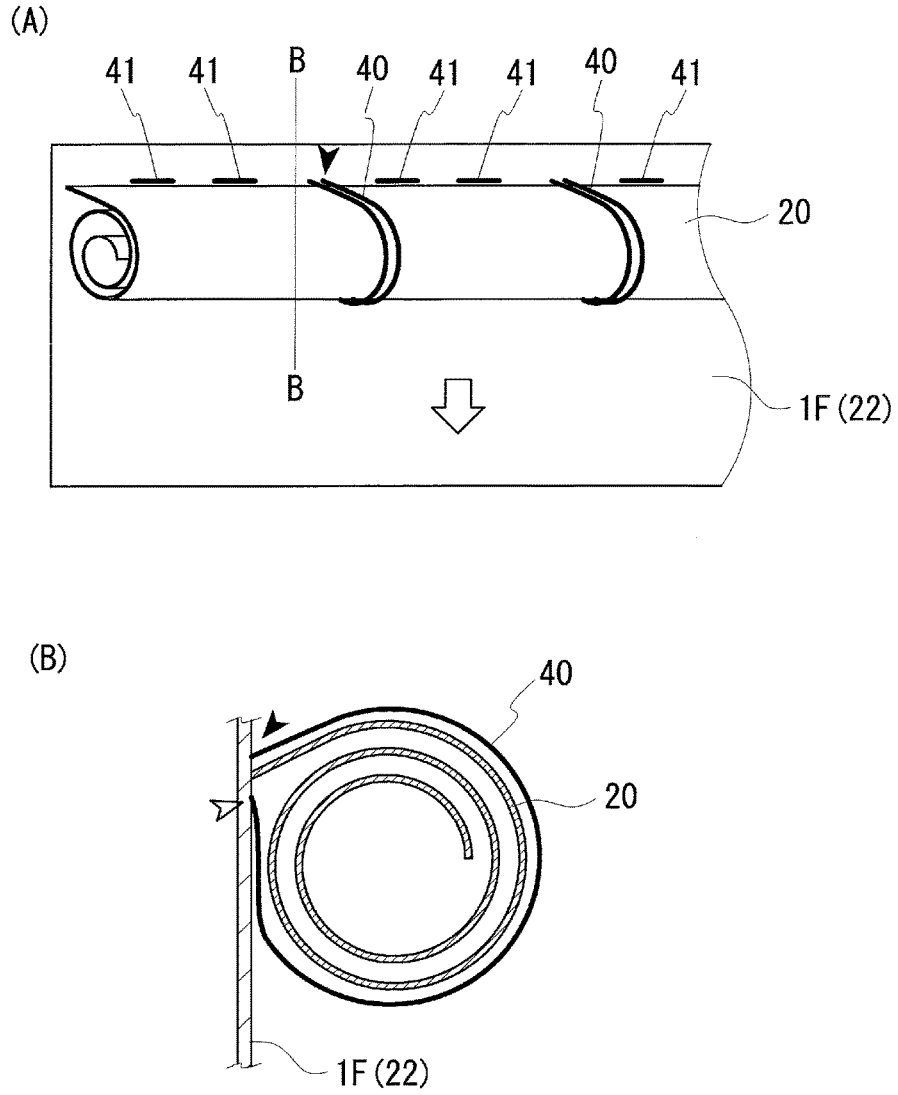
FIG. 5(A) is a schematic view of a stretch preventing section and a holding stitch shown in a third embodiment.
FIG. 5(B) is a cross-sectional view taken along B-B.

In the example shown in FIG. 5, a hem portion 41 that frames the boundary portion of the base knitted fabric portion 1F and the stretch preventing section 20 is formed. The hem portion 41 is configured with stitches interweaved in the base knitted fabric portion 1F when knitting the holding stitch 40.

Figure 6:
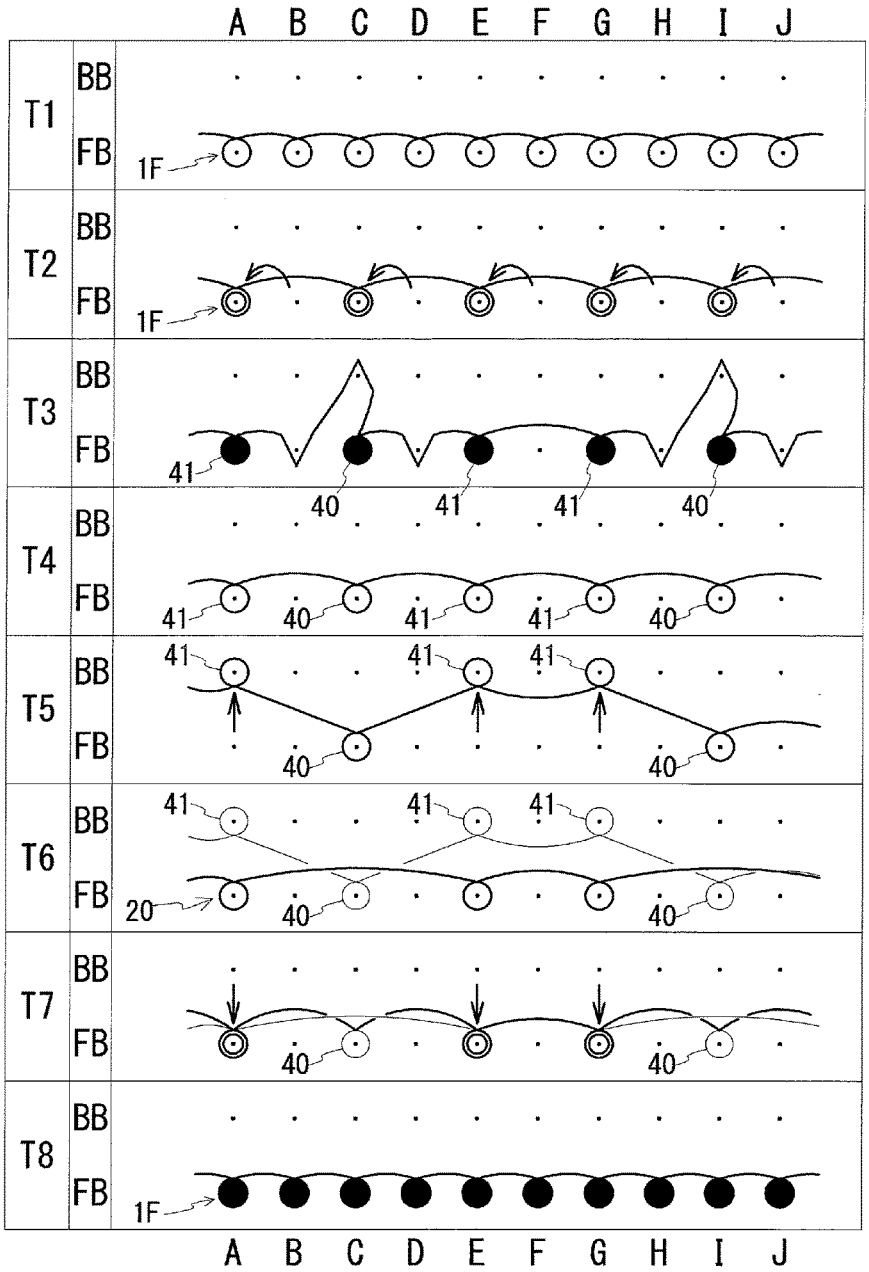
FIG. 6 is a knitting process diagram of the holding stitch shown in the third embodiment.

The holding stitch 40 and the hem portion 41 shown in FIG. 5 can be knitted according to, for example, the knitting process diagram shown in FIG. 6. The FIG. 6 can be viewed in a manner same as FIG. 4.

T1 shows a state in which the base knitted fabric portion 1F is held on A to J of the FB. In T2, the stitches of the knitting needles B, D, F, H, J of the FB are transferred to the knitting needles A, C, E, G, I of the FB, and an empty needle is formed on the knitting needles B, D, F, H, J of the FB.

In T3, a stitch following the wale direction of the stitches of the base knitted fabric portion 1F held on the knitting needles A, C, E, G, I of the FB is knitted, and a pickup stitch is formed on the knitting needles B, D, H, J of the FB and the knitting needles C, I of the BB. In the present example, the stitches of the knitting needles A, E, G of the FB become the stitches of the hem portion 41, and the stitches of the knitting needles C, I of the FB become the holding stitches 40 (corresponding to process $\gamma_1$).

In T4, the pickup stitches formed in T3 are removed from the needle beds. An extra length of the knitting yarn can be obtained between the knitting needles A to J of the FB by an amount the pickup stitches were formed, and the holding stitches 40 can be enlarged.

In T5, the stitches held on the knitting needles A, E, G of the FB are transferred to the knitting needles A, E, G of the BB. After obtaining a state in which only the holding stitches 40 are held on the FB by T5, the knitting of the stretch preventing section 20 is carried out using the knitting needles A, E, G of the FB in T6 (corresponding to $\gamma_2$). The knitting of the stretch preventing section 20 can be carried out through a procedure similar to S5 to S8 of FIG. 4 (corresponding to processes $\alpha_1$, $\alpha_2$).

In T7, the stitches of the hem portion 41 held on the knitting needles A, E, G of the BB are overlapped with the stretch preventing section 20 held on the knitting needles A, E, G of the FB. Then, in T8, the base knitted fabric portion 1F is formed on the knitting needles A to J of the FB, and the stretch preventing section 20 is connected to the base knitted fabric portion 1F (corresponding to process $\alpha_3$), and the stitches of the hem portion 41 and the holding stitches 40 are connected to the base knitted fabric portion 1F (corresponding to process $\gamma_3$).

According to the knitting process described above, the holding stitch 40 for holding the curled shape of the stretch preventing section 20 and the hem portion 41 that frames the boundary of the base knitted fabric portion 1F and the stretch preventing section 20 can be formed, as shown in FIG. 5.

<<Variant>>

The hem portion 41 shown in FIG. 5 can also be knitted with a cross-over yarn. Furthermore, the holding stitch 40 may be configured with a plurality of stitches continuing in the wale direction.

Fourth Embodiment

As opposed to the first and second embodiments, the shoe upper including the stretch preventing section 20 can also be knitted from the heel toward the toe or from the toe toward the heel. In this case, the stretch preventing section 20 that stretches in the vertical direction or the diagonal direction of the shoe upper can be formed in the shoe upper.

DESCRIPTION OF REFERENCE NUMERALS

FB front needle bed
BB back needle bed
1 shoe upper (knitted fabric)
1*s* is set up portion
2 instep cover
21 instep part
22 side part
3 sole cover
1F, 1B base knitted fabric portion
20 stretch preventing section
20*s* starting end (set up portion)
20*n* new stitch row
20*e* terminating end (last new stitch row)
40 holding stitch
41 hem portion
5 foot insertion opening

The invention claimed is:

1. A method for knitting a shoe upper of knitting the shoe upper including a base knitted fabric portion that covers a foot of a wearer using a flat knitting machine including a front needle bed and a back needle bed disposed opposite to each other in a front-back direction; wherein knitting I or knitting II is carried out to knit a stretch preventing section configured by a knitted fabric of a plain structure, one end in a wale direction being connected to the base knitted fabric portion by knitting, and another end in the wale direction being curled without being connected to the base knitted fabric portion;

the knitting I includes carrying out process $\alpha_1$ of knitting, with a stitch of a forming region where the stretch preventing section is formed in the base knitted fabric portion held on only one needle bed, a set up portion of the stretch preventing section on another needle bed, process $\alpha_2$ of knitting a plurality of new stitch rows continuing in a wale direction of the set up portion, and process $\alpha_3$ of connecting the last new stitch row to the stitch of the base knitted fabric portion of the forming region; and knitting II includes carrying out process $\beta_1$ of knitting, with a stitch of the forming region where the stretch preventing section is formed in the base knitted fabric portion held on only one needle bed, a branched stitch row branched from the base knitted fabric portion on another needle bed, process $\beta_2$ of knitting a plurality of new stitch rows continuing in a wale direction of the branched stitch row, and process $\beta_3$ of performing a bind-off process on the last new stitch row.

2. The method for knitting the shoe upper according to claim 1, wherein the shoe upper is knitted from a foot insertion opening side toward a sole side, and the stretch preventing section is knitted according to the knitting I; or the shoe upper is knitted from the sole side toward the foot insertion opening side, and the stretch preventing section is knitted according to the knitting II.

3. The method for knitting the shoe upper according to claim 1, wherein process $\gamma_1$ to process $\gamma_3$ are carried out to knit a holding stitch to be wound around an outer peripheral surface of a curled shape of the stretch preventing section to hold the curled shape of the stretch preventing section;

$\gamma_1$ includes knitting the holding stitch continuing in a wale direction of at least some stitches of the base knitted fabric portion of the forming region before knitting the stretch preventing section;

$\gamma_2$ includes knitting, with only the holding stitch held on the other needle bed, the stretch preventing section with the other needle bed according to the procedure of the knitting I or the knitting II; and $\gamma_3$ includes connecting the holding stitch to the base knitted fabric portion.

4. A shoe upper including a base knitted fabric portion that covers a foot of a wearer; the shoe upper comprising:

a stretch preventing section integrally formed with the base knitted fabric portion; wherein the stretch preventing section is configured with a knitted fabric of a plain structure, one end in a wale direction being connected to the base knitted fabric portion by knitting and another end in the wale direction being curled without being connected to the base knitted fabric portion.

5. The shoe upper according to claim 4, further comprising:

a holding stitch knitted in continuation to a wale direction of a stitch of the base knitted fabric portion, and connected to the base knitted fabric portion while being wound around an outer peripheral surface of a curled shape of the curled stretch preventing section; wherein the curled shape of the stretch preventing section is held by the holding stitch.

6. The method for knitting the shoe upper according to claim 2, wherein process $\gamma_1$ to process $\gamma_3$ are carried out to knit a holding stitch to be wound around an outer peripheral surface of a curled shape of the stretch preventing section to hold the curled shape of the stretch preventing section;

$\gamma_1$ includes knitting the holding stitch continuing in a wale direction of at least some stitches of the base knitted fabric portion of the forming region before knitting the stretch preventing section;

$\gamma_2$ includes knitting, with only the holding stitch held on the other needle bed, the stretch preventing section with the other needle bed according to the procedure of the knitting I or the knitting II; and $\gamma_3$ includes connecting the holding stitch to the base knitted fabric portion.

* * * * *